US006036552A

United States Patent [19]

Atsumi

[11] Patent Number: 6,036,552

[45] Date of Patent: Mar. 14, 2000

[54] CONNECTOR PROVIDED WITH A RETAINER

[75] Inventor: Keigo Atsumi, Yokkaichi, Japan

[73] Assignee: Sumitomo Wiring Systems, Ltd., Japan

[21] Appl. No.: 09/132,821

[22] Filed: Aug. 12, 1998

[30] Foreign Application Priority Data

Aug. 22, 1997 [JP] Japan ..... 9-225974

[51] Int. Cl.[7] ..... H01R 13/434

[52] U.S. Cl. ..... 439/752

[58] Field of Search ..... 439/752, 595

[56] References Cited

U.S. PATENT DOCUMENTS 5,252,096 10/1993 Okada ..... 439/752

5,299,958 4/1994 Ohsumi ..... 439/752

*Primary Examiner*—Gary Paumen

*Attorney, Agent, or Firm*—Banner & Witcoff, Ltd.

[57] ABSTRACT

A retainer 30 of an electrical connector has first and second stopping protrusions 37,38 protruding from the anterior edges of a pair of bendable members 35 and 36 located on the sides thereof. A third stopping protrusion 39 also protrudes from a location below the second stopping protrusion 38. When a retainer 30 is pushed into a final position in a retainer insertion hole 14, the first stopping protrusion 37 and the third stopping protrusion 39 are engaged by a pair of receiving members 18 and 19 located in the retainer insertion hole 14. In this manner the retainer 30 is maintained against removal even if tipped at an angle or subjected to an oblique force. Similar effects apply when the retainer is in a temporary position.

14 Claims, 6 Drawing Sheets

CONNECTOR PROVIDED WITH A RETAINER

TECHNICAL FIELD

The present invention relates to an electrical connector provided with a retainer.

Conventional connectors of this type are as shown in the Japanese Laid-Open Publication 4-127976. As shown in FIG. 8 of this specification, this type of connector is provided with a connector housing 1 which has a plurality of terminal housing chambers 2 for housing terminal fittings. Retainer insertion holes 3 which pass through the side face of the connector housing 1 allow the insertion of a retainer 4. When the retainer 4 is fully inserted, a portion of the retainer 4 protrudes into each terminal housing chamber 2 and engage end faces of the terminal fittings which face in a posterior direction, thus retaining the terminal fittings against removal.

The retainer 4 can be stopped in a shallow inserting position relative to the retainer insertion holes 3, this being a temporary position which allows the removal of the terminal fittings from the terminal housing chamber 2, and in a deeper position in which the retainers 4 fit with the terminal fittings, this being a final position at which the terminal fittings are engaged. As shown in FIG. 9, a stopping member 5 which engages the connector housing 1 in both stopping positions is provided on both sides of the retainer 4. This stopping member 5 is divided into two bendable members 5A and 5B, one longer and one shorter, on the ends of which are provided stopping protrusions 5C and 5D. Stopping faces 6A and 6B provided on the interior side of the retainer insertion hole 3 of the connector housing 1 engage these stopping protrusions 5C and 5D. In the temporary position, the protrusion 5C of the longer bendable member 5A engages the face 6A and, as shown in FIG. 9, in the final position, the protrusion 5D of the shorter bendable member 5B engages the face 6B.

However, in order to easily carry out the insertion of the connector and the retainer 4, a considerable clearance must be provided between the retainer 4 and the retainer insertion hole 3. As a result, the retainer 4 may bend, as shown in FIGS. 10 and 11. In conventional examples, since the stopping member 5 is engaged from only one side in both the temporary and main stopping positions, if the retainer 4 bends as shown in the figures, there is a danger of the engagement being released.

The above invention has been developed after taking the above problem into consideration, and aims to present a connector provided with a retainer in which the retainer is reliably retained in the connector housing.

SUMMARY OF THE INVENTION

According to the invention there is provided an electrical connector comprising a housing having a chamber to receive an electrical terminal, an aperture opening into said chamber, and a retainer insertable in said aperture in an insertion direction to retain a terminal in said chamber, said retainer having a base and two resilient upstanding legs extending in said insertion direction, said legs having respective latching formations thereon for engagement with corresponding latching formations of said aperture, one of said legs having latching formations defining a partially inserted position allowing insertion of a terminal fitting in said chamber, and the other of said legs having latching formations defining a fully inserted position preventing removal of a terminal fitting from said chamber, and said latching formations each comprising a projection and a corresponding step characterized in that said one of said legs has a supplementary latching formation engageable in the fully inserted position with a latching formation of said aperture which in use is associated with the partially inserted position.

Such a retainer is supported against bending forces or oblique loads and is consequently less susceptible to disengagement from the connector housing. Preferably the latching formations comprise projections on said legs engageable with shoulders of said aperture. The shoulders and projections may have appropriate tapered and perpendicular faces to facilitate insertion and resist removal of the retainer.

BRIEF DESCRIPTION OF DRAWINGS

Other aspects of the invention will be apparent from the following description of a preferred embodiment shown by way of example only in the accompanying drawings in which.

DESCRIPTION OF PREFERRED EMBODIMENT

An embodiment of the present invention is described below with reference to FIGS. 1 to 7.

Figure 1:
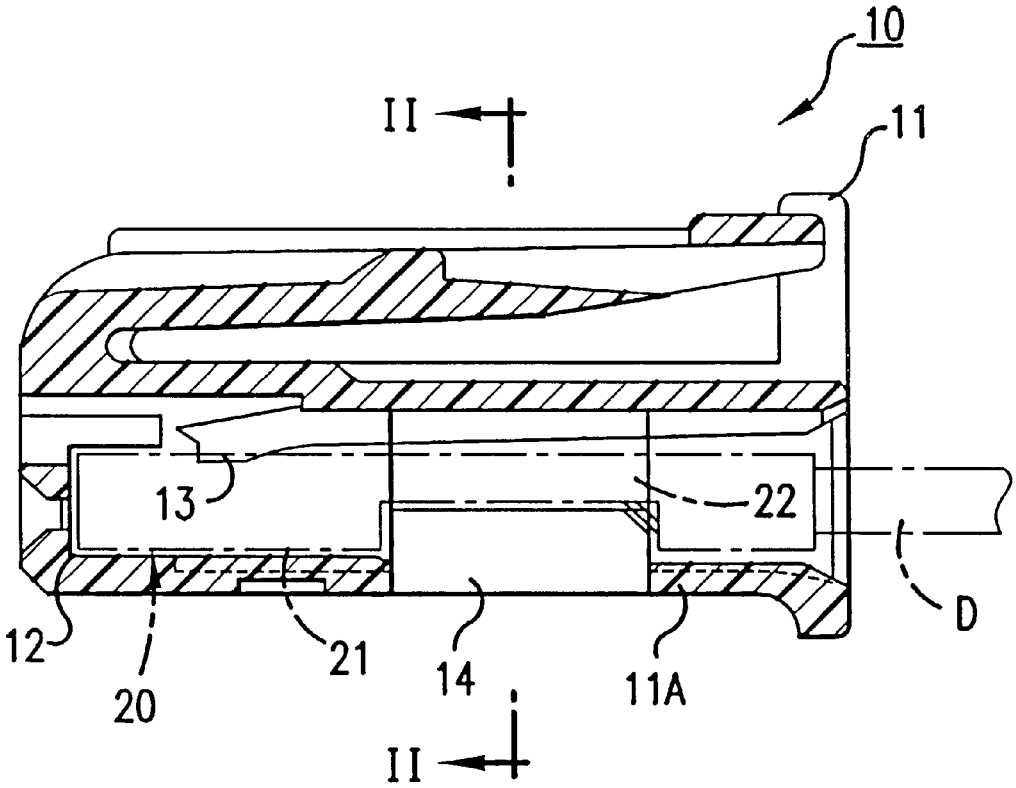
FIG. 1 is a side cross-sectional view of a connector according to the present invention.
Figure 1A:
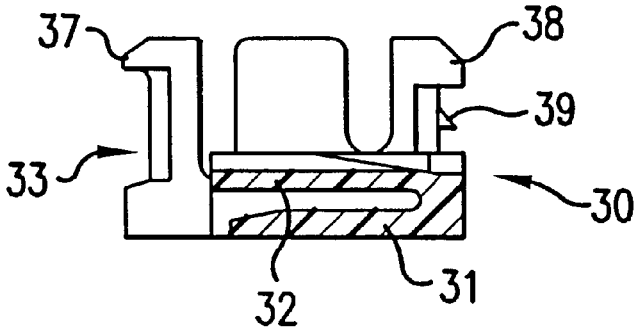
Figure 2:
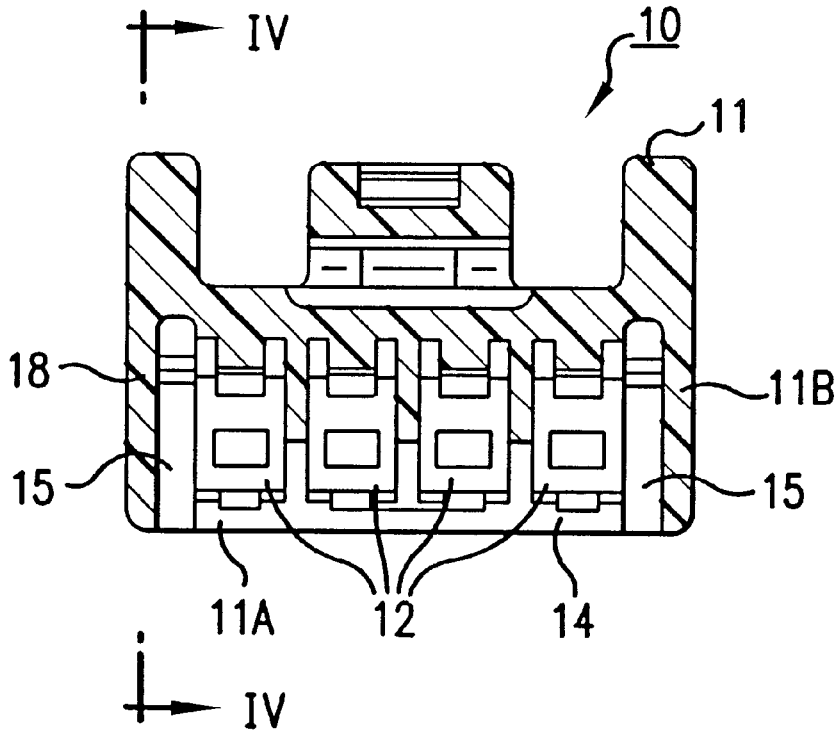
FIG. 2 is a cross-sectional view along II—II in FIG. 1.
Figure 2A:
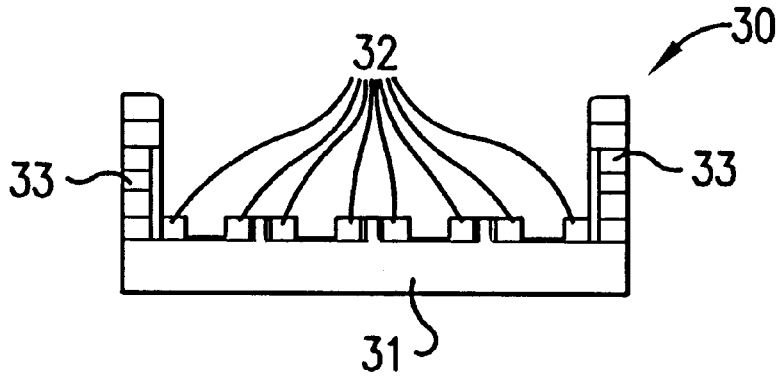

As shown in FIGS. 1 and 2, a connector housing 11 provided in a connector 10 of the present embodiment has a plurality of terminal housing chambers 12 aligned laterally (see FIG. 2), and which pass through it in an anterior-posterior direction (a left-right direction in FIG. 1). A terminal fitting 20 is inserted into each of these terminal housing chambers 12 from the posterior end of the connector housing 11 (the right side in FIG. 1), a lance 13 preventing the movement of each terminal fitting 20 in the direction of removal when the terminal fitting 20 is in the correct position. Further, as shown in FIG. 1, each terminal fitting 20 is provided in anterior and posterior locations with a crimping barrel 22 which crimps a connecting member 21 of a corresponding terminal fitting and an electric wire D.

Figure 3:
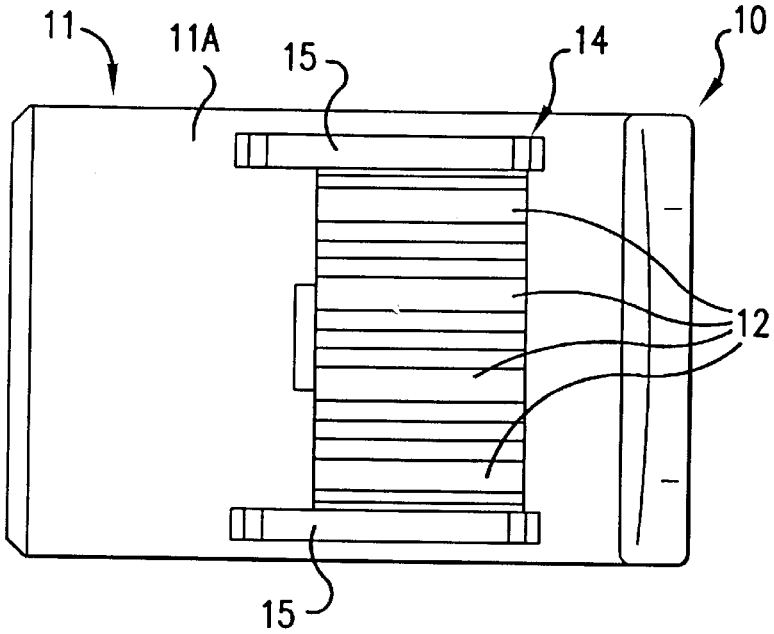
FIG. 3 is a view of the underside of a connector housing.
Figure 4:
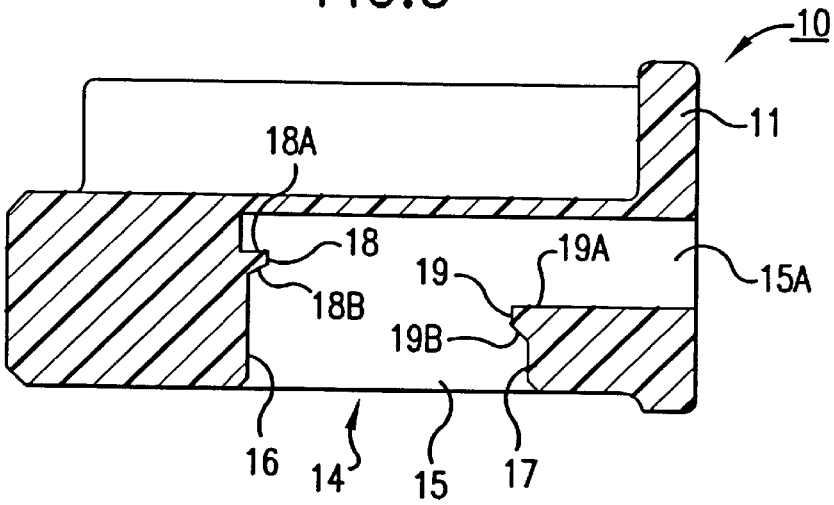
FIG. 4 is a cross-sectional view along IV—IV in FIG. 2.
Figure 4A:
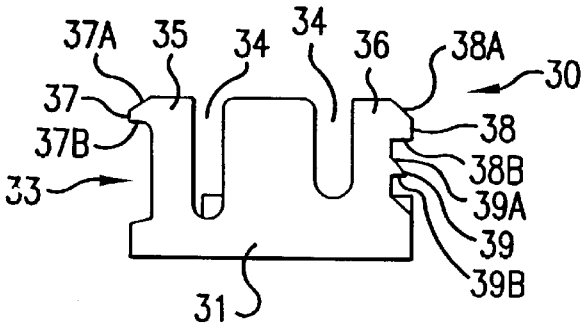

A retainer insertion hole 14 which allows the attachment of a retainer 30 is formed in the wall 11A of the connector housing 11. As shown in FIG. 3, the retainer insertion hole 14 passes through all the terminal housing chambers 12 along the portion of the wall 11A that is central in an anterior-posterior direction (the left-right direction in FIG. 3), both edges thereof being provided with a pair of stopping holes 15 which house protruding members 33 (see FIG. 2) of the retainer 30. As shown in FIG. 2, the stopping holes 15 are formed on the interior portion of side walls 11B of the connector housing 11 and extend directly upwards from openings on the wall 11A. As shown in FIG. 4, apertures 15A extend horizontally from the farther portion of the stopping holes 15 through to the posterior end face of the connector housing 11. Further, a first receiving member 18 protrudes from the upper section of a hole side face 16 (the left side in FIG. 4), and a second receiving member 19 lower than the first receiving member 18 protrudes from a hole side face 17. Upper faces 18A and 19A of the receiving members 18 and 19 extend horizontally relative to FIG. 4 and form faces perpendicular to the hole side faces 16 and 17, while undersides 18B and 19B are tapered.

As shown in FIG. 2, the retainer 30 is provided with a flat sheet-like main body 31, this main body 31 covering the open portions of the terminal housing chambers 12 within the retainer insertion hole 14. A plurality of terminal stopping protrusions 32 are provided within the main body 31, these protruding towards the terminal housing chambers 12. The pair of protruding members 33 stand up in a wall-like manner from the main body 31, a pair of slits 34 being formed in the wall, thereby forming a pair of cantilevered arch-shaped bendable members 35 and 36 which extend in an up-down direction in anterior and posterior portions of the wall (FIG. 4).

A first bendable member 35 is in an anterior location (the left side in FIG. 4) and a first stopping protrusion 37 protrudes from the edge thereof towards the hole side face 16. The second bendable member 36 is located on the posterior side, and a second stopping protrusion 38 protrudes from the edge thereof towards the hole side face 17. The upper faces 37A,37B of these protrusions are tapered, lower faces 37B and 38B thereof being perpendicular, as illustrated. These protrusions 37 and 38 are arranged to be at same height from the main body 31 of the retainer 30 (see FIG. 4) but, as mentioned above, the hole side faces 16 and 17 on which the first and second receiving members 18 and 19 are provided are arranged to have differing heights. In use the retainer 30 is inserted into the retainer insertion hole 14, the second stopping protrusion 38 first passing over the second receiving member 19 (see FIG. 5). Next, the second stopping protrusion 38 is engaged by the upper face 19A of the second receiving member 19, the removal of the retainer 30 is prevented, and the first stopping protrusion 37 is engaged by the lower face 18B of the first receiving member 18. Thus the movement of the retainer 30 in the direction of insertion is regulated. This constitutes the temporary position of the retainer 30, and the terminal stopping protrusions 32 of the main body 31 are about to be inserted into the terminal housing chambers 12. Consequently, at this stage it is possible to remove the terminal fittings 20 from the terminal housing chambers 12.

Figure 6:
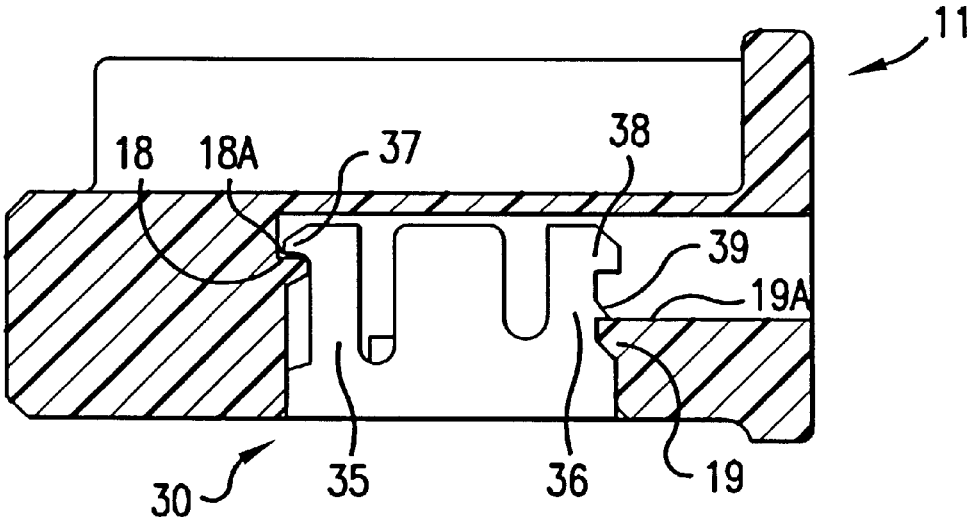
FIG. 6 is a side cross-sectional view showing the connector with the retainer in the final position.
Figure 7:
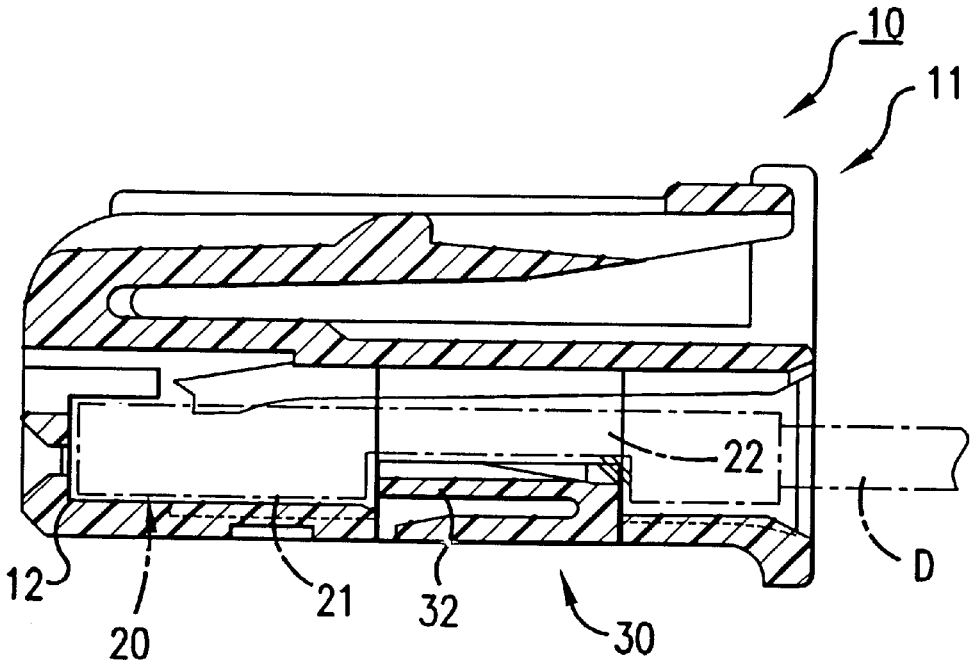
FIG. 7 is a side cross-sectional view of a terminal housing chamber in the final position.
Figure 8:
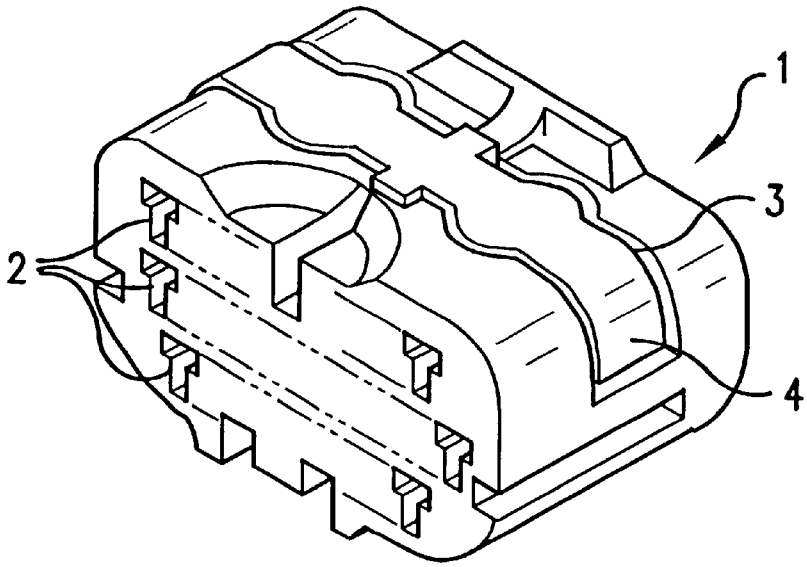
FIG.8 PRIOR ART
FIG. 8 is a diagonal view of a prior art connector.
Figure 9:
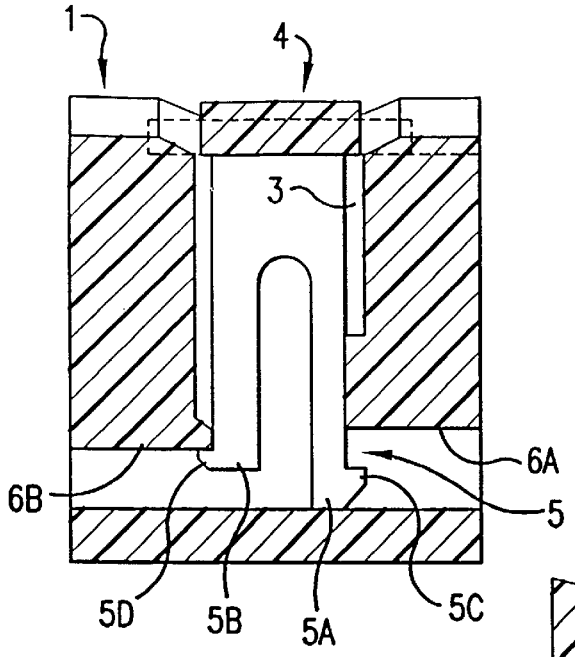
FIG.9 PRIOR ART
FIG. 9 is a partially expanded cross-sectional view of the prior art connector showing the stopping members.
Figure 10:
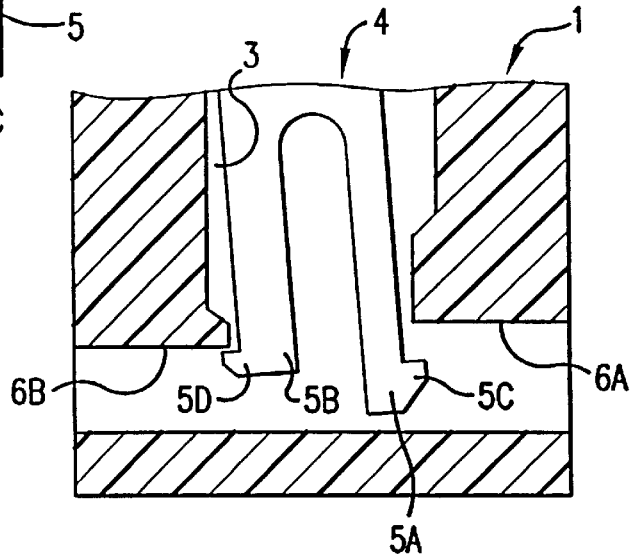
FIG.10 PRIOR ART
FIG. 10 is a partially expanded cross-sectional view of the prior art connector showing the retainer at an oblique angle in the final position.
Figure 11:
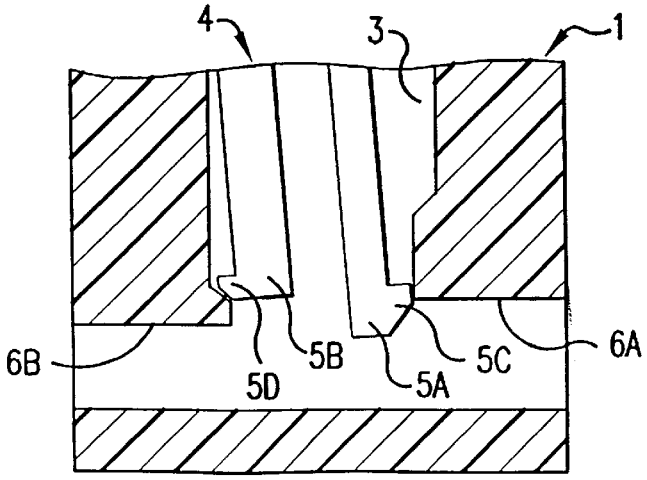
FIG. 11 PRIOR ART
FIG. 11 is a partially expanded cross-sectional view of the prior art connector showing the retainer at an oblique angle in the temporary position.

If the retainer 30 is then inserted more deeply into the interior of the retainer insertion hole 14, the first stopping protrusion 37 passes over the first receiving member 18 and is engaged by its upper face 18A (see FIG. 6). This constitutes the final position, and at this point the terminal stopping protrusions 32 of the main body 31 protrude into the terminal housing chambers 12 (see FIG. 7), and are housed between the connecting member 21 of the terminal fittings 20 and the crimping barrel 22.

Further, as shown in FIG. 4, a third stopping protrusion 39 protrudes from the second bendable member 36 below the second stopping protrusion 38 and faces the hole side face 17. This third stopping protrusion 39 also has an upper face 39A which is tapered, and a lower face 39B which is perpendicular. When the retainer 30 is in the temporary position (see FIG. 5), the third stopping protrusion 39 makes contact with the lower face 19B of the second receiving member 19, and when the retainer 30 is in the final position (see FIG. 6), the third stopping protrusion 39 rises over the second receiving member 19 and is engaged by the upper face 19A of the second receiving member 19.

Figure 5:
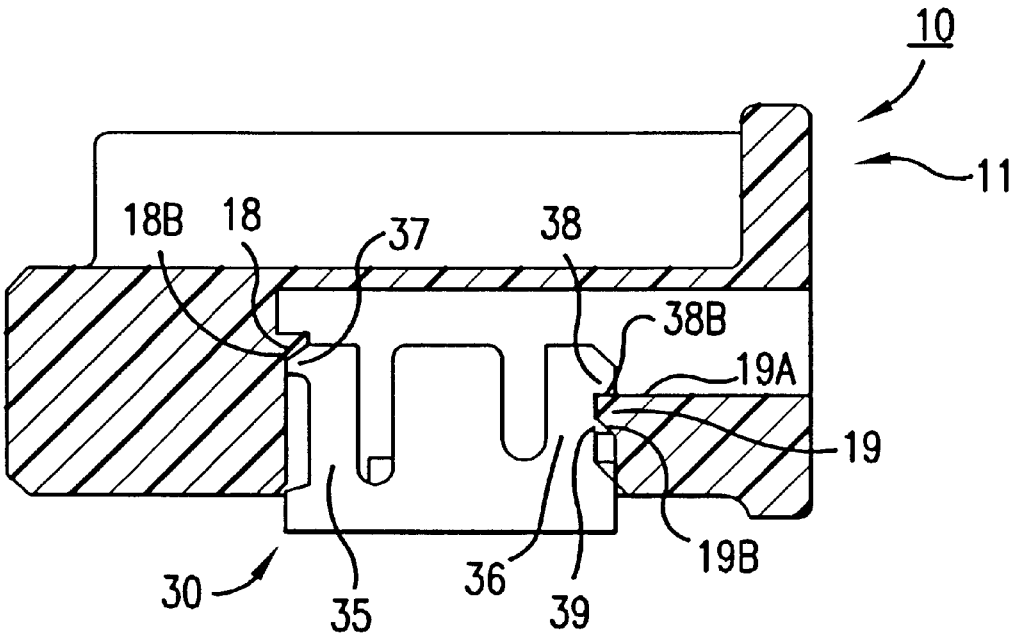
FIG. 5 is a side cross-sectional view showing the connector with a retainer in a temporary position.

The operation and effects of the present embodiment are as follows:

The retainer 30 is attached in the temporary position by pushing the protruding members 33 of the retainer 30 into the holes 15. The upper face 38A of the second protruding member 38 makes contact with the lower face 19B of the second receiving member 19. Both the upper face 38A of the second protruding member 38 and the lower face 19B of the second receiving member 19 are tapered and, if the retainer is pushed in strongly at this point, these faces slide against one another. As a result the second bendable member 36 bends and the second protruding member 38 rises over the second receiving member 19 and reverts to its original state. Both the lower face 38B of the second protruding member 38 and the upper face 19A of the second receiving member 19 are perpendicular. These face one another and temporarily stop the retainer 30 against removal (FIG. 5). At this point the first stopping protrusion 37 and the third stopping protrusion 39 make contact with the lower faces 18B and 19B of the receiving members 18 and 19 respectively, and regulate the movement of the retainer 30 in the direction of insertion.

The main connector 10 is transported to the assembly site in this state. The first stopping protrusion 37 and the third stopping protrusion 39 in the main connector 10 constitute two stopping portions which regulate the movement of the retainer 30 in the direction of insertion. Therefore the retainer 30 is not easily pushed in even if, during transportation, it makes contact with other parts and receives an external force. Moreover, these two stopping portions are located at opposite sides of the stopping holes 15. Consequently, it is difficult for the retainer 30 to bend even if it is pushed in at an angle, and therefore the temporary position is not released as may happen in the conventional example.

At the assembly site, the terminal fittings 20 are inserted into the terminal housing chambers 12 while the retainer 30 is in the temporarily position and, because the terminal stopping protrusions 32 of the retainer 30 do not protrude into the terminal housing chambers 12 in the temporarily state, the terminal fittings 20 can be inserted fully. Each terminal fittings 20 is temporarily supported in the correct position in the terminal housing chamber 12 by the lance 13. The upper faces 37A and 39A of the first protrusion 37 and the third protrusion 39 respectively, and the lower faces 18B and 19B of the receiving members 18 and 19 respectively are all tapered. Accordingly, if the retainer 30 is pushed in fully from its present state, these faces slide against one another. As a result the bendable members 35 and 36 bend and the protrusions 37 and 39 rise over the receiving members 18 and 19, and the bendable members 35 and 36 then revert to their original state. The lower faces 37B and 38B of the protrusions 37 and 38 and the upper faces 18A and 19A of the receiving members 18 and 19 are perpendicular and hold the retainer 30 in the final position. At this point, the terminal stopping protrusions 32 protrude into a location facing the anterior end face of the connecting member 21 of each terminal fitting 20, thus preventing the removal of the terminal fittings 20.

In this final position, if a force is exerted on the retainer 30 in a direction of removal, the first stopping protrusion 37 and the third stopping protrusion 39 in the main connection 10 constitute two stopping portions which maintain the retainer 30 engaged and the reliability of the final position is therefore improved. Further, the two stopping portions are located at opposite sides of the holes 15, these locations being separated from one another. Consequently, it is difficult fro the retainer 30 to bend even if is pushed in at an angle, and therefore the final engagement is not released as may occur in the conventional example. Moreover, the upper face 19A of the second receiving member 19 functions as both a temporary and a final stopping means and the connector can therefore be made more compact.

The present invention is not limited to the embodiments described above. For example, the possibilities described below also lie within the technical range of the present invention. In addition, the present invention may be embodied in various other ways without deviating from the scope thereof.

In the present embodiment, the hole side faces 16 and 17 and the stopping members (the first to third stopping protrusions and the first and second receiving members) are all configured so as to protrude. However, they may equally be configured so that one of these is recessed and the other has a protruding shape and can be engaged therein.

What is claimed is:

1. An electrical connector comprising a housing having a chamber to receive an electrical terminal, an aperture opening into said chamber, and a retainer insertable in said aperture in an insertion direction to retain a terminal in said chamber, said retainer having a base and two resilient upstanding legs extending in said insertion direction, said legs having respective latching formations thereon for engagement with corresponding latching formations of said aperture, one of said legs having latching formations defining a partially inserted position allowing insertion of a terminal fitting in said chamber, and the other of said legs having latching formations defining a fully inserted position preventing removal of a terminal fitting from said chamber, and said latching formations each comprising a projection and a corresponding step characterized in that said one of said legs has a supplementary latching formation engageable in the fully inserted position with a latching formation of said aperture which in use is associated with the partially inserted position.

2. A connector according to claim 1 wherein said latching formations comprise projections of said legs and shoulders of said aperture.

3. A connector according to claim 2 wherein said projections are tapered in said insertion direction.

4. A connector according to claim 2 wherein said shoulders are perpendicular to said insertion direction.

5. A connector according to claim 3 wherein said shoulders are perpendicular to said insertion direction.

6. A connector according to claim 2 wherein said projections have a face perpendicular to the insertion direction on the side opposite to the said insertion direction and adapted for engagement with a corresponding shoulder.

7. A connector according to claim 3 wherein said projections have a face perpendicular to the insertion direction on the side opposite to the said insertion direction and adapted for engagement with a corresponding shoulder.

8. A connector according to claim 4 wherein said projections have a face perpendicular to the insertion direction on the side opposite to the said insertion direction and adapted for engagement with a corresponding shoulder.

9. A connector according to claim 5 wherein said projections have a face perpendicular to the insertion direction on the side opposite to the said insertion direction and adapted for engagement with a corresponding shoulder.

10. A connector according to claim 1 wherein said retainer has a protrusion for engagement with a respective terminal, said protrusion being between said upstanding legs.

11. A connector according to claim 10 wherein said retainer includes a row of said protrusions.

12. A connector according to claim 11 wherein said row is perpendicular to the plane of said legs.

13. A connector according to claim 1 wherein in the partially inserted position, one of said latching formations of said legs and said supplementary latching formation engage on either side of the associated latching formation of said aperture.

14. A connector according to claim 1 wherein said aperture has parallel sides for sliding engagement with said retainer.

* * * * *